US009696060B2

(12) United States Patent
Hohmann

(10) Patent No.: US 9,696,060 B2
(45) Date of Patent: Jul. 4, 2017

(54) TEMPERATURE SENSING AIR DIFFUSER

(71) Applicant: Paul E. Hohmann, Taylors, SC (US)

(72) Inventor: Paul E. Hohmann, Taylors, SC (US)

( * ) Notice: Subject to any disclaimer, the term of this patent is extended or adjusted under 35 U.S.C. 154(b) by 334 days.

(21) Appl. No.: 14/153,060

(22) Filed: Jan. 12, 2014

(65) Prior Publication Data

US 2015/0198348 A1 Jul. 16, 2015

(51) Int. Cl.

| | |
|---|---|
| ***F24F 7/00*** | (2006.01) |
| ***F24F 11/00*** | (2006.01) |
| ***F24F 13/06*** | (2006.01) |
| ***F24F 13/08*** | (2006.01) |
| ***F24F 13/062*** | (2006.01) |

(52) U.S. Cl.

CPC ..... *F24F 13/062* (2013.01); *F24F 2221/14* (2013.01)

(58) Field of Classification Search

CPC ..... F24F 13/062; F24F 2221/14; F24F 11/053

USPC ..... 454/258; 236/49.5

See application file for complete search history.

(56) References Cited

U.S. PATENT DOCUMENTS

| | | | | |
|---|---|---|---|---|
| 5,505,379 | A * | 4/1996 | Wagner | F24F 13/075 236/101 D |
| 6,692,349 | B1 | 2/2004 | Brinkerhoff et al. | |
| 7,828,224 | B2 * | 11/2010 | Yang | F24F 11/0012 236/49.1 |
| 8,180,494 | B2 | 5/2012 | Dawson et al. | |
| 8,249,731 | B2 | 8/2012 | Tran et al. | |
| 8,280,584 | B2 | 10/2012 | Mikat | |
| 8,321,057 | B2 | 11/2012 | Maly | |
| 2003/0054750 | A1 * | 3/2003 | Luik | B60H 1/3421 454/69 |
| 2011/0317398 | A1 * | 12/2011 | Moeck | F21S 10/02 362/84 |

OTHER PUBLICATIONS http://www.acutherm.com: Description of 2x2 Therma-Fuser VAV Diffusers at http://www.acutherm.com/index.php/products/detail/st-2x2-therma-fuser-vav-diffusers, last visited Jan. 20, 2014 (2 pages).
http://www.acutherm.com: TK Therma-Fuser brochure, last visited Jan. 20, 2014 (4 pages).
http://www.acutherm.com.

* cited by examiner

*Primary Examiner* — Helena Kosanovic
(74) *Attorney, Agent, or Firm* — Christopher J. Pfister

(57) ABSTRACT

A temperature controlled air diffuser with a temperature-sensitive element alters the direction of the supply airstream passing through it and into a conditioned airspace, based on the temperature of the supply airstream.

11 Claims, 6 Drawing Sheets

SECTION A-A

RELATED ART

PLAN VIEW

TEMPERATURE SENSING AIR DIFFUSER

BACKGROUND OF THE INVENTION

Current heating and air conditioning systems supply air into a room by forcing air through an air vent, otherwise known as an air diffuser. The conventional air diffuser 8, illustrated in FIGS. 1 and 2, directs air through a neck 9 to a set of directional vanes 7, which directs the air. These vanes 7 are fixed in a preset direction. They are designed to produce uniform air distribution in a lateral direction only, regardless of the temperature of the air that is supplied through them. That is, a modern air diffuser 8 distributes cold, denser air into the space at the same angle as warm, more buoyant air.

Customarily, air coming out of an air diffuser is of a different temperature than the ambient temperature of the room it is being blown into. Cold air is customarily blown through the air diffuser into a warm room, and vice versa. However, given the fixed-blade design of the conventional air diffuser 8, this leads to inconsistent temperatures within the occupied zone, which is typically defined as 4" to 67" above the finished floor (AFF), since warm air tends to rise and cold air tends to sink. When the heating and air conditioning system blows cold air through the conventional air diffuser 8, the air at lower levels in the room will be colder than desired, and when the system blows warm air through the conventional air diffuser 8, the air at higher levels will be warmer than desired.

SUMMARY OF THE INVENTION

Additional features and utilities of the present general inventive concept will be set forth in part in the description which follows and, in part, will be obvious from the description, or may be learned by practice of the general inventive concept.

Exemplary embodiments of the present general inventive concept provide an air diffuser including a directional vane disposed within a main body of the diffuser, the directional vane being configured to direct a flow of supply air passing through the diffuser, the directional vane being rotatably mounted in the diffuser such that the directional vane can direct the supply air in multiple directions depending on an angle of the directional vane to the main body, and a temperature-sensitive element configured to adjust the angle of the directional vane depending on a temperature of the supply air.

The temperature-sensitive element may be a bi-metallic element, the bi-metallic element changing its size or shape depending upon the temperature of the supply air.

The air diffuser may further include a plurality of directional vanes. The temperature-sensitive element may adjust the angel of each of the plurality of directional vales simultaneously.

The air diffuser may further include at least one stationary vane configured to direct air in a given direction.

The air diffuser may further include a movable armature attached to each of the plurality of the directional vanes, the movement of the armature adjusting the angle of each of the plurality of directional vanes to the main body simultaneously.

The temperature-sensitive element may be attached to the armature, the armature being moved according to the size or shape of the temperature-sensitive element.

BRIEF DESCRIPTION OF THE DRAWINGS

These and/or other features and utilities of the present general inventive concept will become apparent and more readily appreciated from the following description of the embodiments, taken in conjunction with the accompany drawings of which.

DETAILED DESCRIPTION OF THE EMBODIMENTS

Figure 1:
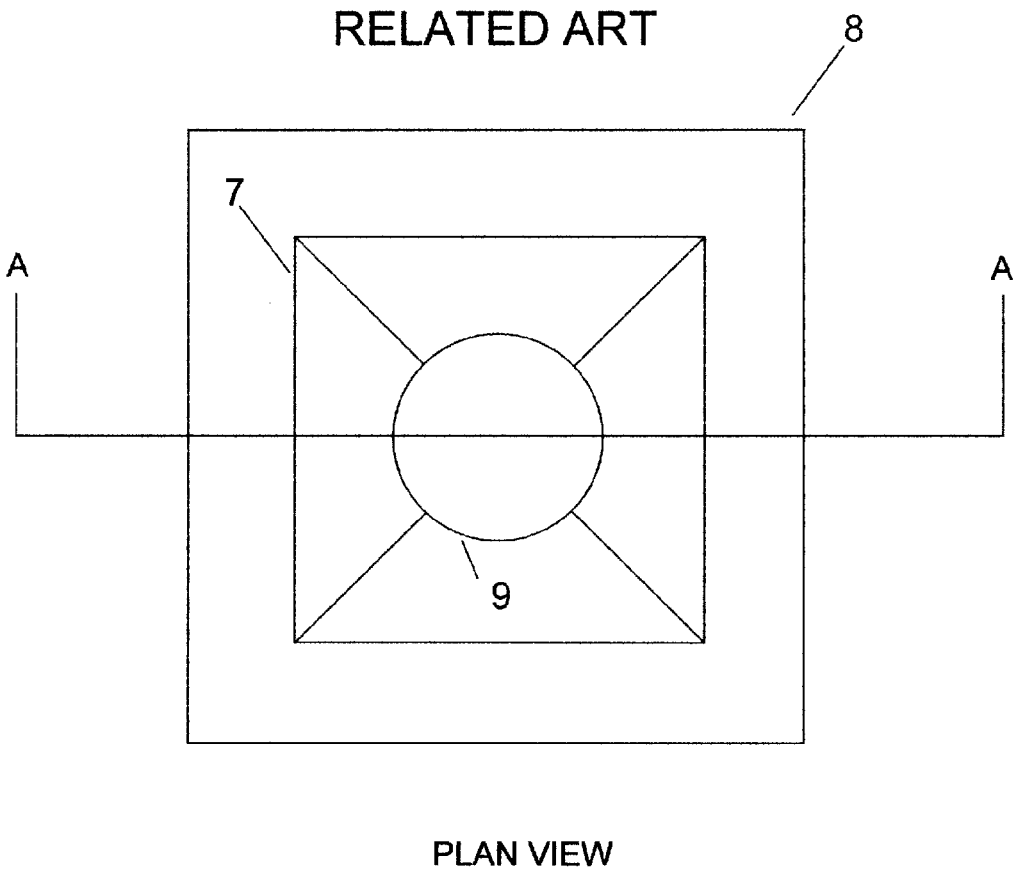
FIG. 1 is a plan view of a conventional air diffuser.
Figure 2:
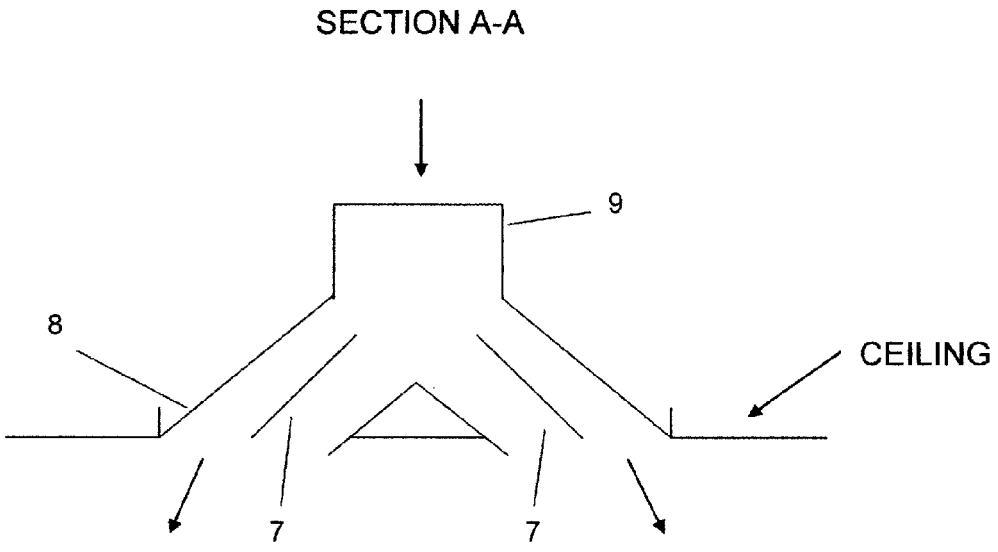
FIG. 2 illustrates a section view cut through line A-A in the air diffuser illustrated in FIG. 1.

Reference will now be made in detail to the embodiments of the present general inventive concept, examples of which are illustrated in the accompanying drawings, wherein like reference numerals refer to like elements throughout. The embodiments are described below to explain the present general inventive concept by referring to the figures.

A temperature controlled diffuser according to the present invention addresses the issue of inconsistent heating and cooling currently exhibited by the prior art. By adjusting the angle of the diffuser vanes based on the temperature of the air flowing through the air diffuser, a conditioned living space's temperature is made more comfortable and more uniform, and the diffuser is made more energy efficient.

For the purposes of this application, it will be understood that "conditioned space," "occupied space," "room," etc. all denote the space which is treated by a heating and air conditioning system using an air diffuser according to the present general inventive concept.

The present general inventive concept is directed to an air diffuser that automatically adjusts the angle of its vanes depending on the temperature of the air passing over them. An exemplary embodiment of the present general inventive concept is described hereinbelow. It will be understood that this is only an exemplary embodiment, and should not be construed as limiting.

Figure 3:
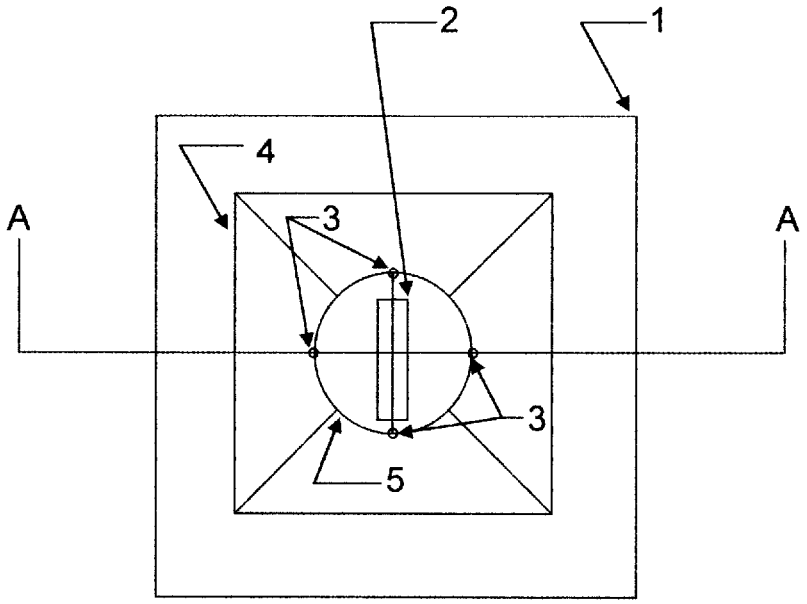
FIG. 3 is a plan view of an exemplary embodiment of an air diffuser according to the present general inventive concept.
Figure 4:
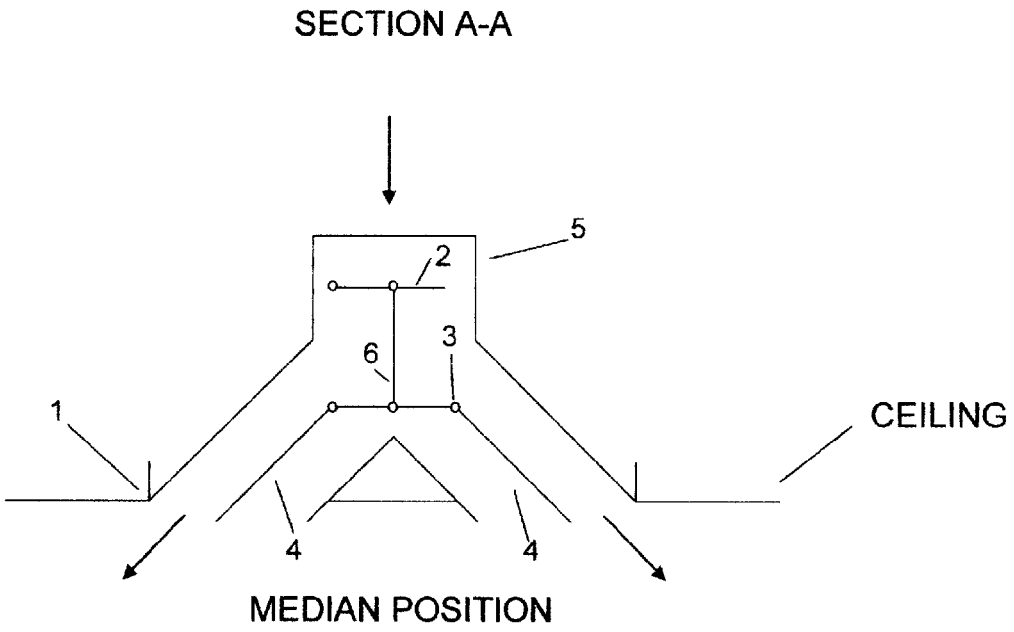
FIG. 4 is a section view cut through line A-A in the air diffuser illustrated in FIG. 3 when the vanes are angled at a neutral position.
Figure 5:
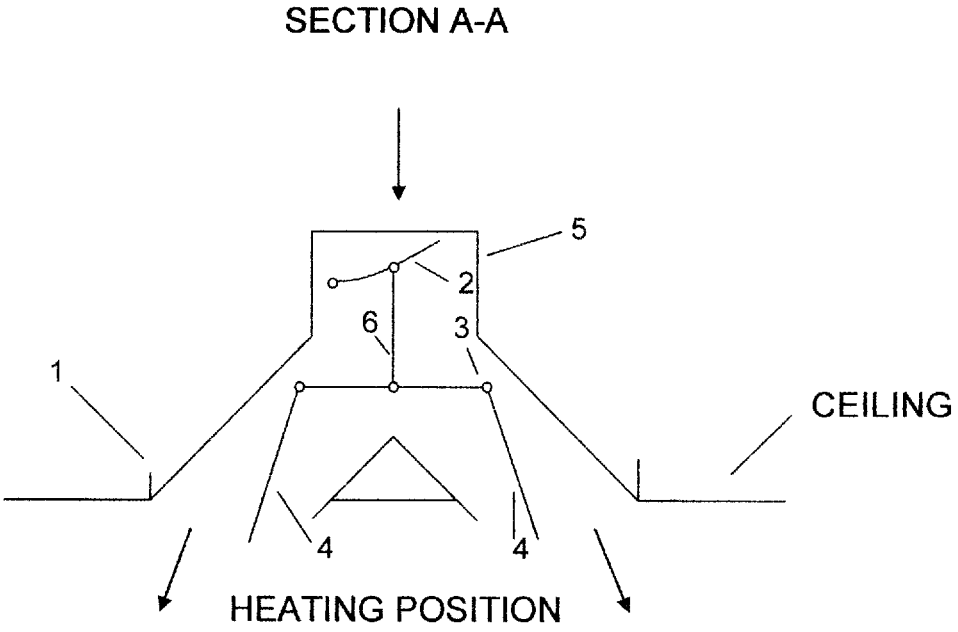
FIG. 5 is a section view cut through line A-A in the air diffuser illustrated in FIG. 3 when the vanes are angled to heat an occupied space.
Figure 6:
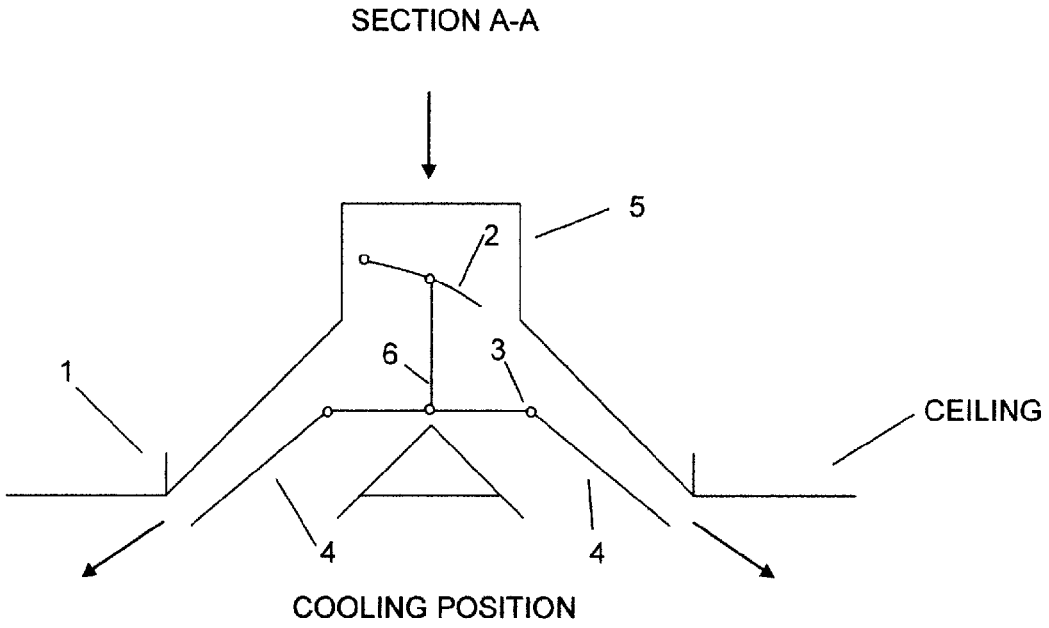
FIG. 6 is a section view cut through line A-A in the air diffuser illustrated in FIG. 3 when the vanes are angled to cool an occupied space.

FIG. 3 is a plan view of an exemplary embodiment of an air diffuser 1 according to the present general inventive concept. FIGS. 4-6 are section views cut through line A-A in the air diffuser 1 illustrated in FIG. 3, illustrating different angles of movable directional vanes 4. Air flows through the air diffuser 1 according to the present exemplary embodiment of the present general inventive concept in the direction of the arrows in FIGS. 4-6. The depicted exemplary embodiment is a diffuser 1 which can alter the direction of a supply airstream coming through a neck 5 into the conditioned airspace based on the temperature of the air being supplied through it.

The air diffuser 1 is a non-powered device that can be installed in a modular ceiling frame, gypsum or other solid ceiling, wall or floor. The air diffuser 1 includes an inlet neck 5 which securely connects the air diffuser 1 to the supply ductwork (not illustrated), thus providing an airtight seal. Inside the air diffuser 1 is a temperature-sensitive element 2 which can transfer temperature variations into a mechanical movement. This temperature-sensitive element 2 can be, for example, a bi-metallic spring, a heat sensitive wax, or other such device. The temperature-sensitive element 2 may expand and contract significantly depending on the temperature of the air flowing through the diffuser 1. As illustrated in FIGS. 4-6, the temperature-sensitive element 2 may be located in e.g., the neck 5 of the air diffuser 1. Furthermore. the temperature-sensitive element 2 may move in a direction parallel to the supply airstream coming through the neck 5 as the temperature-sensitive element expands and contracts depending on the temperature of the air flowing throat the diffuser 1.

In the exemplary embodiment of the present general inventive concept illustrated in FIGS. 3-6, the temperature-sensitive element 2 is connected to movable directional vanes 4, the vanes being mounted on hinges 3 so they are freely rotatable about their individual axes. These directional vanes 4 may be held at a uniform angle by a linkage or armature 6. When the armature 6 is moved up or down, it adjusts the angle of the vanes. FIG. 4 is a section view cut through line A-A in the air diffuser 1 illustrated in FIG. 3 when the directional vanes 4 are angled at a neutral position, which may be approximately 45 degrees. The directional vanes 4 may be in this neutral position when the supply air going through the diffuser 1 is approximately the same temperature as the room.

The temperature-sensitive element 2 may be attached to the armature 6, such that when the temperature-sensitive element 2 changes its size or shape, it moves the armature 6 and accordingly changes the angle of the directional vanes 4.

If the air diffuser 1 is of a sufficiently large size or has a higher air velocity passing through it, then the air diffuser 1 may further include a stabilizing element (not illustrated) to assist the armature to keep the directional vanes stable.

As air supplied through the air system (the "supply air") passes through the air diffuser 1, it flows past the temperature-sensitive element 2. The temperature-sensitive element 2 reacts to the temperature of the supply air and changes its size or shape, thereby exerting a force on the armature 6. The armature 6 has its position modified by this force, and accordingly modifies the angle of the directional vanes 4 of the diffuser to direct the air stream.

FIG. 5 is a section view cut through line A-A in the air diffuser illustrated in FIG. 3 when the vanes are angled to heat an occupied space. When warm air is passing through the air diffuser (such as when the central thermostat is in a heating mode), the directional vanes 4 are moved to a lower elevation, aiming warm air lower into the room. This would direct the supply air away from the ceiling and allow it to mix with the ambient air in the occupied space as it rises up through the occupied space. This allows for more uniform air mixing in the occupied space.

The converse of the above situation is also true in the present exemplary embodiment of the present general inventive concept. FIG. 6 is a section view cut through line A-A in the air diffuser illustrated in FIG. 3 when the vanes are angled to cool an occupied space. As the temperature of the supply air decreases (such as when the central thermostat is in A/C mode), the temperature-sensitive element 2 reacts to raise the angle of the directional vanes 4. This directs the cold supply air higher into the room. This directs the supply air closer to the ceiling and allows the colder air to mix with the ambient air in the occupied space as it settles down into the space, thus providing more uniform air mixing in the occupied space.

Since the immediate temperature around the temperature-sensitive element 2 will be directly related to the temperature of the air going through the diffuser 1, it follows that the angle of the directional vanes 4 is adjusted depending on the temperature of the air passing through the diffuser 1.

An air diffuser 1 according to this exemplary embodiment of the present general inventive concept would not require any external power. It would be completely self-contained and once the unit was installed it would be hands-free, requiring no further user manipulation. Based on the initial setting of the armature 6 in the diffuser 1, which would be addressed during the installation, the diffuser 1 could be installed in a ceiling, a wall, or a floor, depending on the location of the vent. This initial setting defines the neutral position of the directional vanes 4. In this manner, the diffuser 1 can be configured to direct air according to the location where it is mounted. For example, when the diffuser 1 is mounted close to a floor, the diffuser 1 could be configured to direct warm air at a shallow angle close to the floor while the cooler air would be supplied through a steeper angle up into the space.

Furthermore, the air diffuser 1 according to the present general inventive concept is not limited to the above-described directional vanes 4. Other exemplary embodiments of the present general inventive concept may include for example a plurality of vanes 4, connected to the armature 6 such that each of the plurality of vanes 4 has the same angle to the main body of the diffuser 1 at any given time. This plurality of vanes 4 would have their angles simultaneously adjusted by the movement of the armature 6.

Other exemplary embodiments of the present general inventive concept include for example stationary vanes (not illustrated) which do not adjust to the temperature of the supply air. Combining stationary vanes with the directional vanes 4 may give a greater diversity to the distribution of the air through the diffuser 1. Additionally, if the diffuser 1 is mounted close to an obstruction such as a wall, changing the direction of directional vanes 4 facing the obstruction would not produce significant changes in air distribution. Accordingly, the directional vanes 4 of an air diffuser 1 which face an obstruction may be replaced with stationary vanes without affecting performance of the diffuser 1.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. An air diffuser, comprising:

a neck disposed within a main body of the diffuser, the neck receiving supply air traveling in a supply direction;

at least one directional vane disposed within the main body of the diffuser and downstream of the neck in the supply direction, the at least one directional vane including a first end mounted on a hinge in the diffuser and a second end opposite the first end, a length of the at least one directional vane extending from the first end to the second end, the at least one directional vane being configured to pivot about an axis perpendicular to the length to direct a flow of supply air passing through the diffuser and along the length of the at least one directional vane, such that the at least one directional vane directs the supply air in a plurality of directions depending on an angle of the at least one directional vane to the main body; and a temperature-sensitive strip mounted upstream of the hinge in the supply direction, the temperature-sensitive strip being configured to move in a direction parallel to the supply direction to adjust the angle of the at least one directional vane depending on a temperature of the supply air, wherein the at least one directional vane pivots about the hinge such that the second end of the at least one directional vane moves in a direction opposite the direction of the movement of the temperature-sensitive strip.

2. The air diffuser of claim 1, wherein the temperature-sensitive strip is a bi-metallic element, the bi-metallic element changing its size or shape depending upon the temperature of the supply air.

3. The air diffuser of claim 1, further comprising:

a plurality of directional vanes, wherein the temperature-sensitive strip adjusts the angle of each of the plurality of directional vanes simultaneously.

4. The air diffuser of claim 3, further comprising:

a movable armature attached to each of the plurality of the directional vanes, the movement of the armature adjusting the angle of each of the plurality of the directional vanes to the main body simultaneously.

5. The air diffuser of claim 4, wherein:

the temperature-sensitive strip is attached to the armature, the armature being moved according to the size or shape of the temperature-sensitive strip.

6. The air diffuser of claim 5, wherein the armature is moved in a direction parallel to the supply direction according to the size or shape of the temperature-sensitive strip.

7. The air diffuser of claim 1, wherein the temperature-sensitive strip is disposed within the neck.

8. The air diffuser of claim 1, further comprising:

a first directional vane having a width extending in a first direction; and a second directional vane having a width extending in a second direction perpendicular to the first direction.

9. The air diffuser of claim 1, further comprising:

a first directional vane disposed on a first side of the air diffuser; and a second directional vane disposed on a second side of the air diffuser opposite the first side of the air diffuser.

10. The air diffuser of claim 1, wherein the second end of the at least one directional vane is unattached to the main body of the diffuser.

11. The air diffuser of claim 1, wherein the temperature-sensitive strip is a heat-sensitive wax.

* * * * *